US005938500A

United States Patent [19]

Hampton

[11] Patent Number: 5,938,500

[45] Date of Patent: Aug. 17, 1999

[54] COMBINATION BRASSIERE AND UNDERGARMENT HAVING REMOVABLE CUPS

[76] Inventor: Sally A. Hampton, 5574 Onacrest Dr., Los Angeles, Calif. 90043

[21] Appl. No.: 08/858,734

[22] Filed: May 19, 1997

Related U.S. Application Data

[63] Continuation-in-part of application No. 08/422,343, Apr. 14, 1995, abandoned.

[51] Int. Cl.[6] ..... A41C 1/06

[52] U.S. Cl. ..... 450/32; 450/53; 450/54; 2/73

[58] Field of Search ..... 2/73, 109, 110, 2/267; 450/2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 70, 86, 87, 88, 89, 90, 91; 240/587, 528

[56] References Cited

U.S. PATENT DOCUMENTS

| | | | |
|---|---|---|---|
| 230,462 | 7/1880 | Bortree | 450/55 |
| 237,295 | 3/1881 | Bortree | 450/32 X |
| 406,491 | 7/1889 | Williams | 450/57 |
| 622,220 | 4/1899 | Goldsborough | 24/587 |
| 2,126,591 | 8/1938 | Voss | 450/13 |
| 2,816,293 | 12/1957 | Graf | 450/88 X |
| 2,888,931 | 6/1959 | Schaumer | 450/88 X |
| 3,557,413 | 1/1971 | Engle | 24/576 |

*Primary Examiner*—Jeanette E. Chapman
*Attorney, Agent, or Firm*—Roy A. Ekstrand

[57] ABSTRACT

An undergarment includes a torso covering cincher having a pair of downwardly curved underwire portions together with a pair of removably attachable breast-supporting cups. The breast-supporting cups define attachment members which cooperate with attachment members formed on the underwires to removably secure the breast-supporting cups to the torso covering undergarment. Embodiments are shown utilizing a torso covering garment referred to as a cincher and various attachment mechanisms are utilized in securing the breast-supporting cups.

13 Claims, 4 Drawing Sheets

FIG. 9
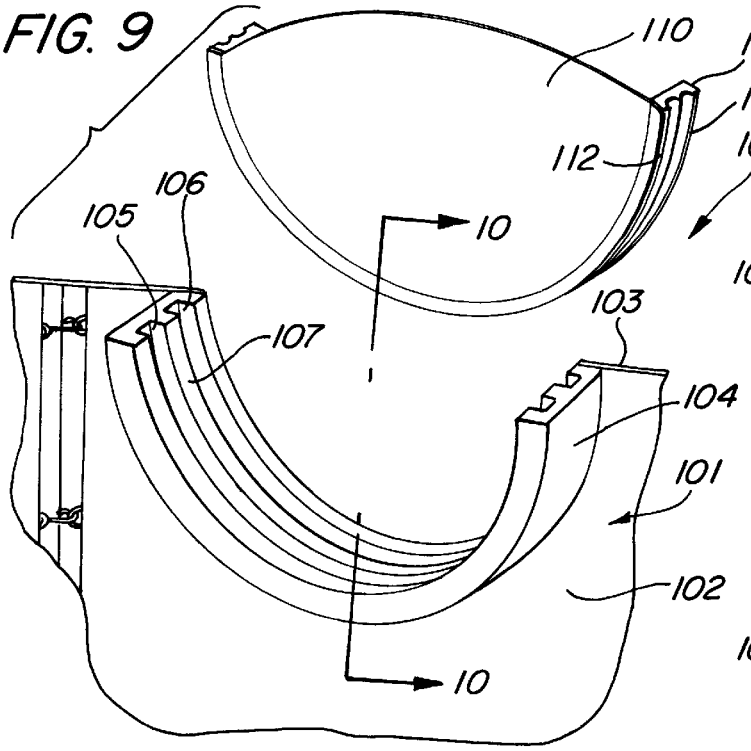
FIG. 10A
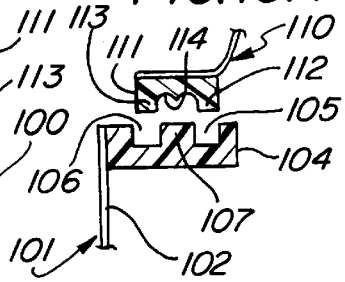
FIG. 10B
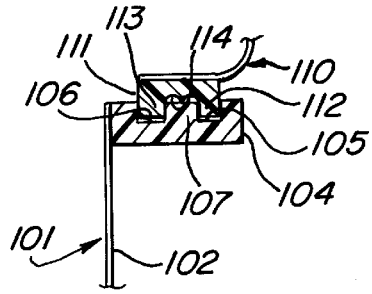
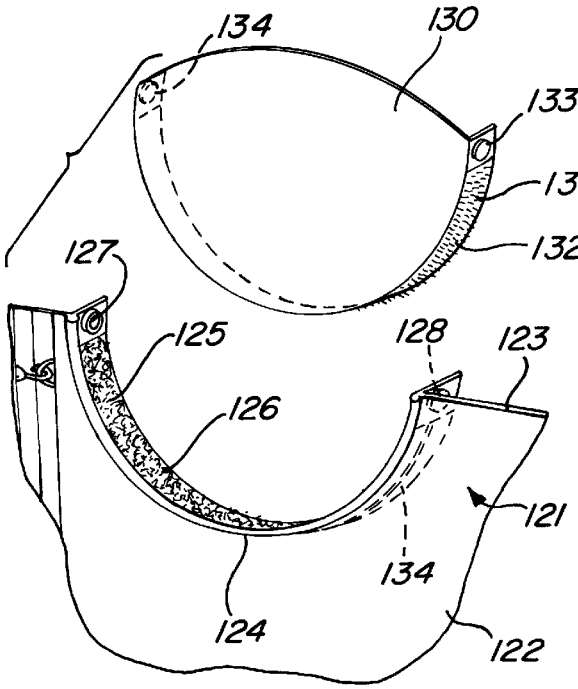
FIG. 11
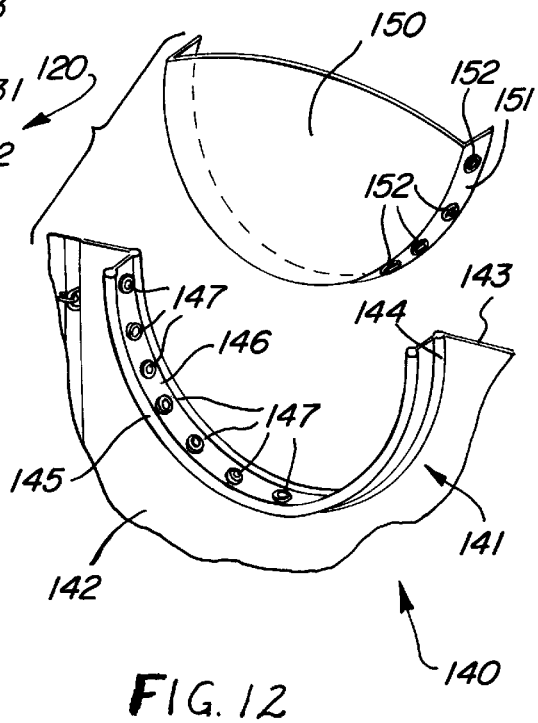
FIG. 12

COMBINATION BRASSIERE AND UNDERGARMENT HAVING REMOVABLE CUPS

CROSS REFERENCE TO RELATED PATENT APPLICATION

This application is a continuation-in-part of a copending application entitled COMBINATION BRASSIERE AND UNDERGARMENT HAVING REMOVABLE CUPS, filed Apr. 14, 1995, having Ser. No. 08/422,343 now abandoned on behalf of the applicant of the present application.

FIELD OF THE INVENTION

This invention relates generally to female undergarments and particularly to those which provide a torso or midriff slimming characteristic.

BACKGROUND OF THE INVENTION

A substantial number of women's undergarments have been produced which are directed toward the general objective of forming and supporting different portions of human female torsos. For example, the now common brassiere provides a pair of breast-supporting cups together with various combinations of supports and straps to provide the desired support and shaping of the female bustline. A variety of other undergarments provided for introducing a forming or slimming effect to the torso has been provided under various names which have included corsets, girdles, midriff supports, foundation garments, waist cinchers or simply cinchers. Such garments often provide the desired slimming or forming characteristic but equally often tend to be uncomfortable to wear especially for extended periods of time. In addition, such garments have a tendency to move or shift upon the wearer's torso as the wearer moves about and undergoes movement such as sitting, rising, bending and so forth.

Recognizing the problems associated with such undergarments, practitioners in the art have endeavored to provide various improvements. Such improvements have included combination undergarments in which a brassiere and corset are combined in removable attachments as well as other undergarment combinations. For example, U.S. Pat. No. 4,154,249 issued to Darring sets forth a MIDRIFF CONTROLLING UNDERGARMENT having an upper torso encircling portion and a lower torso encircling pants portion releasibly connected together at a parting plane located approximately at the waist of the user. A plurality of circumferentially spaced snaps are provided on adjacent edges of the upper and lower portions releasibly joining them together in an overlapping relationship. The upper portion includes breast-supporting cups and straps similar to a brassiere.

U.S. Pat. No. 230,462 issued to Bortree sets forth a CORSET comprising an undergarment having a torso worn portion together with an upper portion defining downwardly concave breast-supporting portions. A pair of slide rails are secured to each side of the downwardly extending breast cup receiving portions which terminate in spaced apart lower ends. A pair of breast cups formed to provide a concave interior breast receiving portion are provided with elongated slide attachments which slidably engage the attachments on the torso-worn garment. The slidable attachment of the breast-supporting cups facilitates easy vertical movement of the breast-supporting cups with respect to the remainder of the garment. In addition, each breast cup further supports a pair of elongated elastic bands which are secured at their lower ends to the breast cups and their upper ends are attachable after having been stretched to the upper portion of the torso-worn garment. When assembled to the torso-worn garment, the breast cups are vertically movable due to the sliding attachment thereof and are biased upwardly toward raised positions by the elastic bands. The objective of Bortree is to provide a combination garment in which the breast cups are movable in response to the wearer's breast movements as the wearer bends, stoops or stands erect.

U.S. Pat. No. 3,185,156 issued to Steinberger sets forth a COMBINED BRASSIERE AND GIRDLE ATTACHED TOGETHER BY ZIPPER MEANS having a lower torso covering girdle and an upper midriff torso covering brassiere joined at the wearer's waistline by a zipper attachment. The upper torso portion includes a pair of breast-supporting cups and straps similar to a conventional brassiere.

U.S. Pat. No. 1,031,069 issued to Hensley sets forth a CORSET ATTACHMENT having a torso defining an upper edge extending just beneath the wearer's breast and a crescent-shaped body comprised of two similar half parts attachable to the upper edge of the corset to provide a breast covering garment.

U.S. Pat. No. 2,525,666 issued to Glynn sets forth a GIRDLE AND BRASSIERE AND HOLD DOWN MEANS THEREFOR having a girdle configured to be worn upon the lower torso and a brassiere having a midriff slimming portion extending downwardly therefrom worn in an overlapping fashion. A plurality of hold down straps are secured to the bottom edge of the brassiere and extend downwardly beneath the girdle to prevent the lower portion of the brassiere from riding up on the wearer's torso.

U.S. Pat. No. 1,966,973 issued to Siegel sets forth a GARMENT having a lower torso worn girdle and an upper torso garment including a brassiere joined together at the wearer's waist. Means of attachment are provided between the upper and lower torso garments.

U.S. Pat. No. 1,625,664 issued to Kispert sets forth a COMBINED CORSET AND BRASSIERE having a corset wearable upon the lower torso and a brassiere wearable upon the upper torso joined together at a common seam near the wearer's waist.

U.S. Pat. No. 2,010,592 issued to Hollar sets forth a COMPOSITE GARMENT having a lower torso worn girdle portion supporting a plurality of downwardly extending hose straps and an upper edge. A brassiere worn upon the upper torso portion includes a downwardly extending edge and a plurality of attachment straps for securing the lower edge of the brassiere to the upper edge of the corset.

U.S. Pat. No. 3,327,714 issued to Steinberger sets forth a COMBINED BRASSIERE AND SLIP ATTACHED TOGETHER BY ZIPPER MEANS having a long line brassiere defining a lower edge and a half slip defining an upper edge. A zipper attachment is provided between the lower edge of the brassiere and the upper edge of the slip to provide removable attachment. In an alternate embodiment, a corset is attached to the brassiere in place of the slip.

U.S. Pat. No. 2,505,616 issued to Goldberg sets forth a FOUNDATION GARMENT having a torso fitting garment extending from the wearer's shoulders downwardly and including a lower portion taking the place of panties. A pair of shoulder pads are built into and secured to the upper portion of the garment.

U.S. Pat. No. 1,378,676 issued to Heindrich sets forth a DETACHABLE BRASSIERE AND CORSET COMBINATION having an upper torso brassiere portion and a lower torso corset portion. The brassiere portion includes a rear panel extending downwardly past the girdle and terminating in stocking support straps.

U.S. Pat. No. 2,402,782 issued to Schwartz sets forth a TWO-PIECE NIGHTGOWN having a lower skirt portion and an upper body portion joined at the wearer's waistline.

U.S. Pat. No. 2,899,962 issued to Entringer, et al. sets forth a BASIC UNDERGARMENT AND BOUFFANT having a lower torso covering undergarment or corset supporting a short skirt portion having a plurality of attachment snap members along the lower edge thereof. A multiply pleated bouffant is securable to the snap members to provide a removable garment bouffant.

While the foregoing described prior art devices have provided improvement in the art and, in some instances, have enjoyed commercial success, they fail to provide an undergarment with removably attachable cups which once attached remain immovable with respect to the undergarment. Thus, there remains nonetheless a continuing need in the art for more comfortable, practical and conveniently utilized undergarments and brassiere combinations.

SUMMARY OF THE INVENTION

Accordingly, it is a general object of the present invention to provide an improved undergarment. It is a more particular object of the present invention to provide an improved undergarment which combines a brassiere and undergarment. It is a still more particular object of the present invention to provide a combination brassiere and undergarment having removably attachable breast-supporting cups which once attached provide immovable breast support.

In accordance with the present invention, there is provided a combination brassiere and undergarment comprising: a torso covering garment portion having an upper edge and a sheath for enclosing a portion of a wearer's torso; a pair of breast-supporting cups each defining a curved lower edge; a pair of underwires fixedly secured to the sheath and extending downwardly from the upper edge to form upwardly open edges corresponding generally to the lower edges of the pair of breast-supporting cups; first attachment means fixedly secured to the lower edge of the breast-supporting cups; and second attachment means, supported on the upwardly open edges of the underwires, for cooperating with the first attachment means to fixedly attach the pair of breast-supporting cups to the torso covering garment portion in a removable attachment such that the breast-supporting cups when attached by the cooperation of the first and second attachment means become fixedly attached to the torso covering garment and remain immovable with respect to the torso covering garment at the position defined by the attachment thus formed despite movement by a wearer.

The invention also contemplates a combination brassiere and undergarment comprising: a torso-worn waist-constricting garment; a pair of breast-supporting cups; and attachment means providing a pair of underwire supports for removably attaching the pair of breast-supporting cups to the torso-worn waist-constricting garment such that a fixed attachment is formed to provide a combination garment in which the pair of breast-supporting cups are fixedly attached to the torso-worn waist-constricting garment maintaining the breast-supporting cups in fixed relationship to the torso-worn waist-constricting garment.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 9 sets forth a partial perspective assembly view of a further alternate embodiment of the present invention combination brassiere and undergarment;

FIGS. 10A and 10B set forth section views of the combination brassiere and undergarment shown in FIG. 9 taken along section lines 10—10 therein;

FIG. 11 sets forth a partial perspective assembly view of a still further alternate embodiment of the present invention combination brassiere and undergarment; and FIG. 12 sets forth a partial perspective assembly view of a still further alternate embodiment of the present invention combination brassiere and undergarment.

DESCRIPTION OF THE PREFERRED EMBODIMENTS

Figure 1:
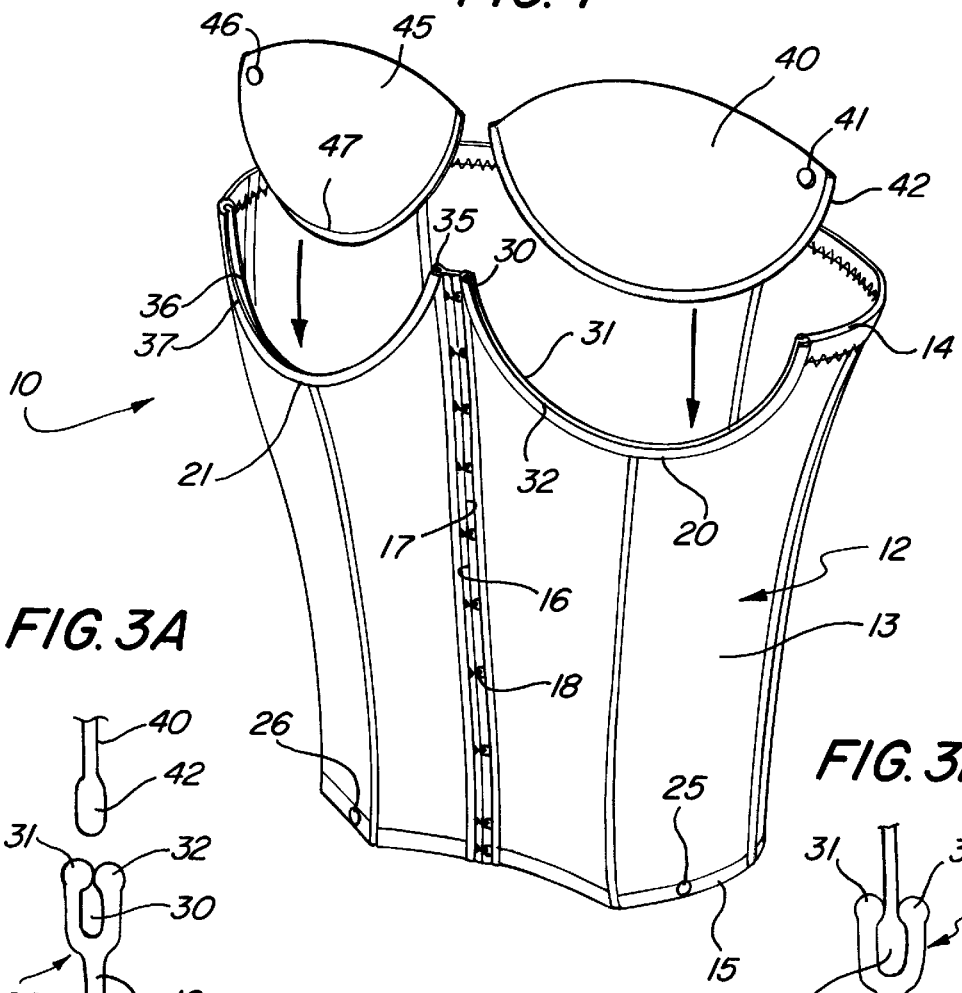
FIG. 1 sets forth a perspective assembly view of a combination brassiere and undergarment constructed in accordance with the present invention.

FIG. 1 sets forth a perspective assembly view of a combination brassiere and undergarment constructed in accordance with the present invention and generally referenced by numeral 10. Garment 10 includes a cincher 12 formed of a resilient sheath of fabric 13 having an upper edge 14 and a lower edge 15. A front seam is formed by edges 16 and 17 of resilient sheath 13 which are joined by a plurality of fasteners 18. Lower edge 15 of resilient sheath 13 further supports a pair of attachment members 25 and 26. A pair of downwardly curved underwires 20 and 21 are secured to resilient sheath 13 and extend downwardly from upper edge 14. The structure of underwire 20 is set forth below in FIGS. 2 and 3 in greater detail. Suffice it to note here however that underwire 20 defines a channel 30 having resilient beads 31 and 32 on either side thereof. Underwire 20 may, for example, be formed of a resilient plastic material or the like. Underwire 21 is identical to underwire 20 and defines a channel 35 having beads 36 and 37 on either side thereof.

Figure 2:
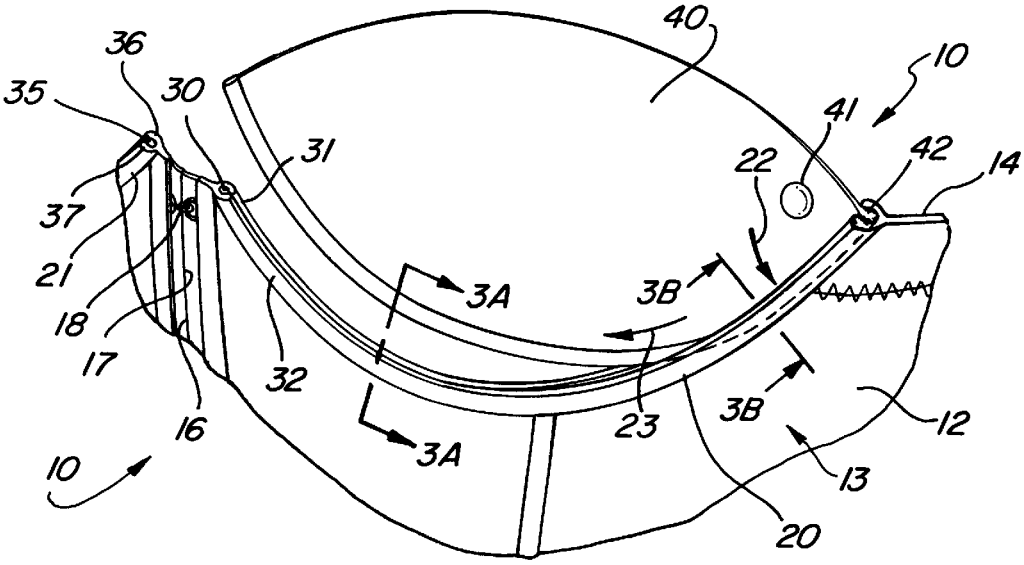
FIG. 2 sets forth a partial perspective view of the present invention combination brassiere and undergarment showing the attachment of a removable cup.

In further accordance with the present invention, garment 10 includes a pair of breast-supporting cups 40 and 45 each defining curved lower edges supporting a downwardly extending bead. Cup 40 supports a bead 42 which as is better seen in FIGS. 2 and 3 is received within channel 30 of underwire 20 to secure the lower edge of cup 40 to underwire 20 and cincher 12. Cup 40 also includes an attachment member 41 which as is better seen in FIG. 4 is utilized in securing a shoulder strap to cup 40. Cup 45 is identical to cup 50 and supports bead 47 which is identical to bead 42 and which is received within channel 35 of underwire 21 to secure the lower edge of cup 45 to cincher 12. By way of further similarity, cup 45 includes an attachment member 46 which as is better seen in FIG. 4 is utilized in securing a shoulder strap thereto.

In accordance with an important aspect of the present invention, garment 10 provides a continuous cincher 12 which may define sufficient length to provide a lower portion extending downwardly to the wearer's lower torso and an upper portion extending above the midriff or bodice portion of the wearer. In its preferred embodiment, underwires 20 and 21 are positioned beneath the wearer's breasts such that cups 40 and 45 provide breast-supporting cups in a manner similar to a conventional brassiere. Toward this end, once cups 40 and 45 are attached, they remain immovable with respect to the remainder of garment 10. Thus, firm breast support is maintained despite movements by the wearer. In further accordance with an important aspect of the present invention, cincher 12 is free of horizontally extending seams or junctions due to its one-piece construction extending between lower edge 15 and upper edge 14. This one-piece construction is facilitated by the removable attachment of cups 40 and 45 directly to underwires 20 and 21 of cincher 12. The resulting undergarment is substantially free of the problems encountered by prior art undergarments utilizing multiple garment portions joined along various junctions or seams upon the wearer's waist or torso.

In accordance with further advantage of the present invention, cups 40 and 45 are removably attached and may be interchanged with other similarly structured cups to provide the advantages of multiple cup shapes and types to suit the needs of the wearer thus adding greatly to the usefulness and flexibility of use of cincher 12. Thus, cups 40 and 45 may be replaced by alternative cups for suiting different fashions or different undergarments and support needs on the part of the user while still retaining the use of cincher 12.

It should be noted that the removable characteristic of the breast-supporting cups used in the present invention garment refers to their ability to be removed from and secured to the cincher of the garment. This removable attachment is accomplished using various fastening apparatus in which the cups are pressed in place, slid into place, snapped into place or the like. Of importance to the present invention, however, is the characteristic that, once attached, the cups are immovable with respect to the remainder of the garment despite movement of the wearer. This characteristic is described herein as immovable attachment. As a result, the cups are removable and interchangable but once attached and during use by a wearer they are immovable with respect to the remainder of the garment.

Thus, once cups 40 and 45 are secured to cincher 12, they are immovable with respect thereto despite user movement. Further, the entire garment while free of annoying seams and overlaps is nonetheless a virtually continuous garment from the wearer's upper torso to the lower torso spanning the wearer's midriff and providing the desired slimming and forming effect. The result is an undergarment which overcomes the problems of prior art devices such as the above-referenced Bortree (U.S. Pat. No. 230,462). In prior art devices such as Bortree '462, the breast-supporting cups are movably coupled to the garment such that wearer movement causes the breast-supporting cups to move about. This has been found to be uncomfortable to the wearer. The present invention immovable cup attachment prevents this discomfort.

As is well known, women have a substantial variety of body types and proportions. For example, some women have larger torsos and waists and proportionally smaller breasts. Conversely, some women have thinner torsos and slimmer waists and proportionally larger breasts. This variation of body proportion emphasizes a major advantage of the present invention undergarment in that cups of different sizes may be used with the torso garment or cincher. As a result, the user may independently choose a cincher suited to her torso size and shape and attach breast-supporting cups corresponding to her breast size.

In addition to use with cups 40 and 45 attached, cincher 12 of the present invention garment may be worn with cups 40 and 45 removed using underwires 20 and 21 for under support of the breasts. Also, cincher 12 may be worn without cups 40 and 45 attached together with a conventional brassiere. All of this simply provides greater variety of use of the present invention for the wearer.

FIG. 2 sets forth a perspective assembly view of the removable cup portion of the present invention garment. As described above, garment 10 includes a cincher 12 having an upper edge 14 and supporting downwardly curved underwires 20 and 21. As is also described above, cincher 12 includes a sheet 13 having edges 16 and 17 joined along the frontal portion of cincher 12 by a plurality of fasteners 18. Underwire 20 defines a channel 30 having resilient beads 31 and 32 on each side thereof. Underwire 20 may be formed within resilient sheath 13 or separately formed of molded plastic material or the like and secured thereto using conventional attachment means such as stitching or sewing. Underwire 21 is identical to underwire 20 and defines a channel 35 having resilient beads 36 and 37 on either side thereof.

Cup 40 is shaped to receive and support the wearer's breast and defines a curved bead 42 along its lower edge. Curved bead 42 is shaped and configured to be resiliently received within channel 30 of underwire 20 by forcing bead 42 between beads 31 and 32 of underwire 20. In the assembly shown in FIG. 2, bead 42 is initially forced into channel 30 of underwire 20 near upper edge 14 in the direction indicated by arrow 22. As portions of bead 42 are resiliently received within channel 30, the remaining portion of bead 42 is progressively inserted moving the point of bead insertion along underwire 20 in the direction indicated by arrow 23 until the entire length of bead 42 is resiliently received within channel 30. It will be apparent to those skilled in the art however that alternative approaches to attaching cup 40 to underwire 20 may be utilized without departing from the spirit and scope of the present invention. It will be equally apparent to those skilled in the art that the identical structure of bead 47 of cup 45 (seen in FIG. 1) and underwire 21 facilitates the attachment of cup 45 to underwire 21 in the same manner illustrated for the attachment of cup 40 to underwire 20. Thus, the descriptions set forth herein relating to cup 40 and underwire 20 should be understood to apply equally well to cup 45 and underwire 21.

The removal of cup 40 from underwire 20 is carried forward in essentially the reverse manner as that described for installation. More specifically, the user simply grasps cup 40 near bead 42 preferably at either end thereof and using controlled force withdraws bead 42 from channel 30. During this withdrawal, the flexible nature of beads 31 and 32 on either side of channel 30 facilitate the withdrawal.

Figure 3A:
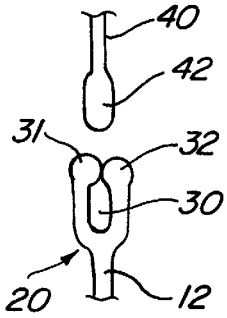
FIG. 3A sets forth a section view of the present invention combination brassiere and undergarment taken along section lines 3A—3A in FIG. 2.
Figure 3B:
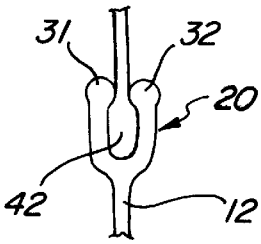
FIG. 3B sets forth a section of the present invention combination brassiere and undergarment taken along section lines 3B—3B in FIG. 2.
Figure 4:
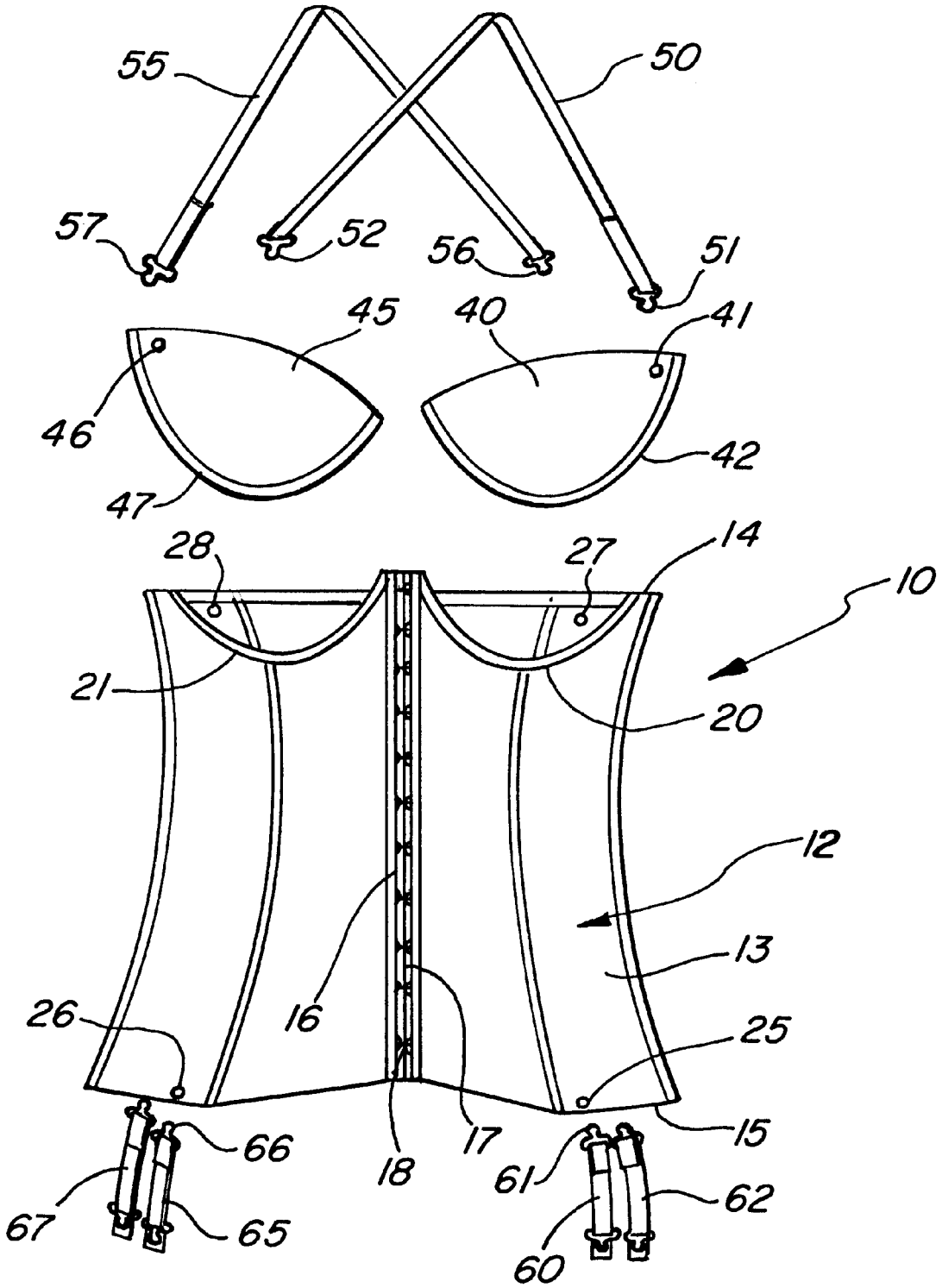
FIG. 4 sets forth an assembly view of the present invention combination brassiere and undergarment.

FIGS. 3A and 3B set forth section views of underwire 20 and bead 42 taken along section lines 3A—3A and 3B—3B respectively in FIG. 2. Thus, FIG. 3A sets forth bead 42 secured to the bottom edge of cup 40 and extending downwardly therefrom together with underwire 20 secured to cincher 12 and extending upwardly therefrom prior to installation or attachment of cup 40. Underwire 20 defines a channel 30 having beads 31 and 32 formed on each side thereof. As described above, underwire 20 is preferably formed of a somewhat resilient material having sufficient flexibility and resilience to facilitate the forcing of bead 42 between beads 31 and 32 to be received within channel 30 for attachment of cup 40 to cincher 12.

FIG. 3B sets forth the section view of bead 42 joined to underwire 20. As can be seen, bead 42 is preferably shaped in general correspondence to the interior of channel 30 and facilitates the grasping of bead 42 by beads 31 and 32 of underwire 20.

It should be noted that underwire 20 and bead 42 cooperate once cup 40 is attached to underwire 20 to provide the underwire brassiere support often provided in conventional brassieres using separate wires or flexible members. Similarly, bead 47 and underwire 21 (seen in FIG. 1) cooperate to provide underwire support for cup 45 once cup 45 is attached to cincher 12 in the above-described manner. This provides further advantage to the present invention combination brassiere and undergarment in avoiding the need for additional underwire apparatus. However, it may be desirable in certain applications to provide additional underwire support combined with or secured near underwires 20 and 21 should the user prefer. Such additional underwire support may be provided without departing from the spirit and scope of the present invention.

It should also be noted by review of FIGS. 1 and 4 that the present invention undergarment may be worn without brassiere straps as shown in FIG. 1 or with straps as shown in FIG. 4. In accordance with an important aspect of the present invention, cups having greater support may be attached to cincher 12 for strapless use or alternatively softer, more comfortable, cups may be attached to cincher 12 for use with straps as shown in FIG. 4. Also, the cup structures may be varied for different degrees of uplift and cleavage as the user desires.

It is important in this regard to bear in mind that the present invention is not a detachable brassiere as shown in the prior art. It is an undergarment in which a torso sheath is combined with removable and interchangeable breast supporting cups. This difference facilitates greater flexibility of use and allows the present invention garment to meet a wide variety of uses.

FIG. 4 sets forth the present invention garment together with additional shoulder strap and hosiery straps in a typical combination. Thus, garment 10 includes a cincher 12 having a resilient sheath 13 defining an upper edge 14, a lower edge 15 and frontal edges 16 and 17. Edges 16 and 17 are commonly joined by a plurality of fasteners 18. A pair of underwires 20 and 21 curve downwardly from upper edge 14 of resilient sheath 13. Cincher 12 further includes a pair of attachment members 27 and 28 on the rear surface thereof as well as a plurality of lower edge attachment members such as attachment members 25 and 26. As described above, garment 10 includes removable cups 40 and 45 having downwardly curved beads 42 and 47 on the lower edges thereof. As is also described above, beads 42 and 47 are received within underwires 20 and 21 respectively to secure cups 40 and 45 to cincher 12. A shoulder strap 50 includes attachment members 51 and 52 on each end thereof which are secured to attachment members 41 and 27 of cup 40 and cincher 12 respectively. Similarly, a shoulder strap 55 includes attachment members 56 and 57 at each end thereof which are secured to attachment members 46 and 28 of cup 45 and cincher 12 respectively. In a similar fashion, straps 60, 62, 65 and 67 are securable to the lower edge of cincher 12 to provide attachment and support for hosiery or the like in accordance with conventional fabrication techniques. For example, strap 60 includes an attachment member 61 by which strap 60 is secured to attachment member 25 while strap 65 includes an attachment member 66 by which strap 65 is secured to attachment member 26. Thus, a plurality of hosiery supporting straps may be secured to the lower edge of cincher 12 to complete the undergarment.

It will be apparent to those skilled in the art that while the embodiment set forth in FIGS. 1 through 4 utilizes beads 42 and 47 upon cups 40 and 45 together with underwires 20 and 21 upon cincher 12, the present invention may alternatively be practiced by reversing the attachment components to provide a channeled member upon the lower edge of cups 40 and 45 and a corresponding bead upon underwires 20 and 21.

Figure 5:
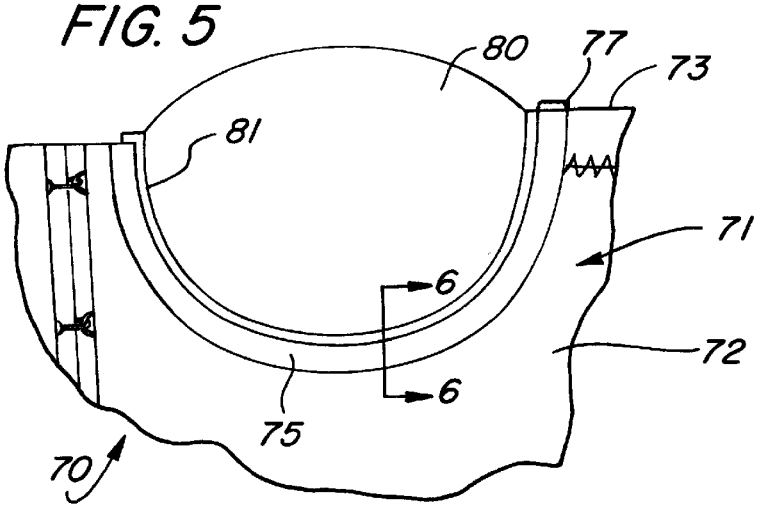
FIG. 5 sets forth a partial front view of an alternate embodiment of the present invention combination brassiere and undergarment.

FIG. 5 sets forth a partial front view of an alternate embodiment of the present invention generally referenced by numeral 70. Garment 70 is substantially identical to garment 10 with the exception being the use of different attachment apparatus between the cup and cincher. More specifically, garment 70 includes a cincher 71 substantially identical to cincher 12 formed of a resilient sheath 72 which is substantially identical to resilient sheath 13. Thus, resilient sheath 72 defines an upper edge 73 and supports a curved underwire 75. Underwire 75 defines a closed end 77 at the outer side portion of cincher 71. Garment 10 further includes a cup 80 having a bead 81 received within underwire 75 in the manner shown in FIGS. 6, 7 and 8. Suffice it to note here however that cup 80 is secured to cincher 71 in a removable fashion through the cooperative attachment of bead 81 within underwire 75. While not seen in FIG. 5, it will be apparent to those skilled in the art that garment 70 supports a second cup and underwire identical to cup 80 and underwire 75.

Figure 6:
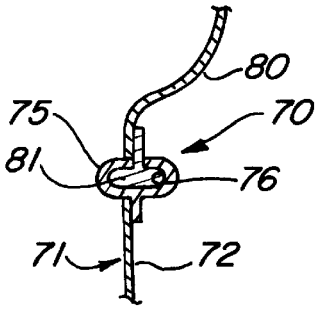
FIG. 6 sets forth a partial section view of the combination brassiere and undergarment shown in FIG. 5 taken along section lines 6—6 therein.

FIG. 6 sets forth a partial section view of cup 80 and cincher 71 taken along section lines 6—6 in FIG. 5. As described above, garment 70 includes a cincher 71 formed of a resilient sheath 72 supporting an underwire 75. Underwire 75 defines an interior channel 76. Underwire 75 is secured to resilient sheath 72 using conventional fabric attachment means (not shown) such as sewing, stitching or adhesive attachment. Garment 70 further includes a removable cup 80 having a bead 81 secured to the lower edge thereof. Bead 81 is configured to generally correspond to the interior of channel 76. Thus, bead 81 is received and captivated within channel 76 to provide removable attachment between cup 80 and cincher 71.

Figure 7:
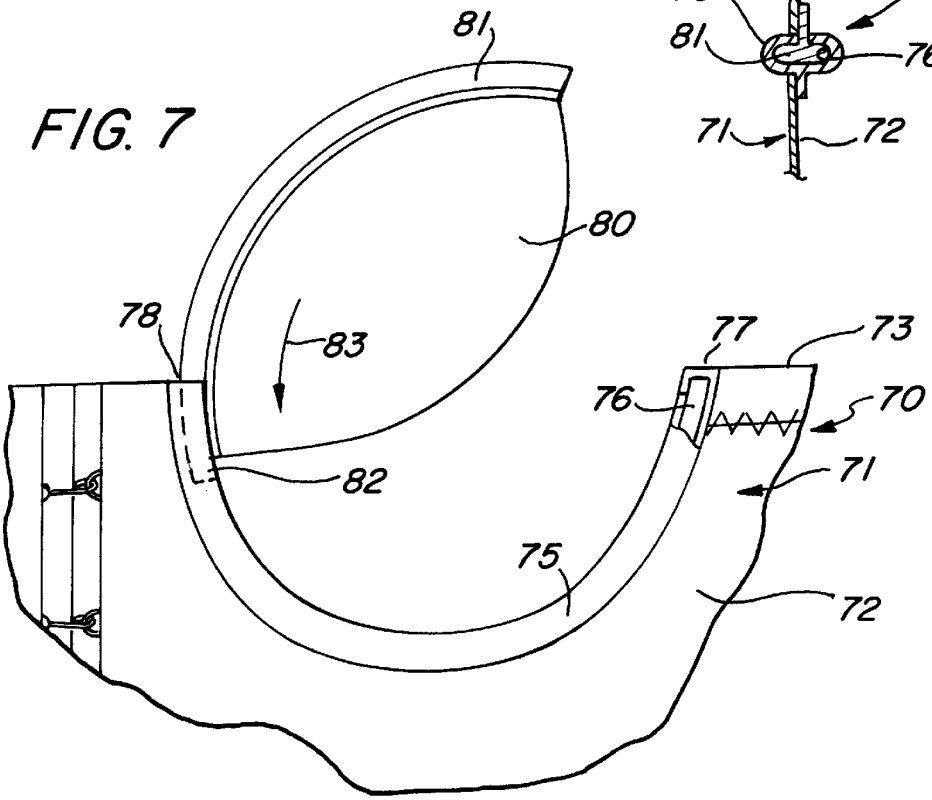
FIG. 7 sets forth a partial assembly view of the combination brassiere and undergarment of FIG. 5 during assembly of the removable cup.

FIG. 7 sets forth a partial section view of garment 70 showing the attachment of cup 80 to cincher 71. More specifically, garment 70 includes a cincher 71 formed of a resilient sheath 72 having an upper edge 73 and supporting a curved underwire 75. Underwire 75 defines a closed end 77, an interior channel 76 and an open end 78. A cup 80 supports a curved bead 81 on the lower edge thereof which in turn defines an end tab 82. As is shown in FIG. 6, bead 81 is configured to correspond generally to channel 76 and be received and secured therein. Accordingly, cup 80 is preferably attached to cincher 71 sliding end tab 82 through open end 78 of underwire 75 in the manner shown. Thereafter, cup 80 is generally rotated sliding bead 81 in the direction indicated by arrow 83 to move end tab 82 toward closed end 77 of underwire 75. The function of closed end 77 which is preferably positioned at the outer side portion of cincher 71 is to prevent cup 80 from sliding beyond underwire 75. Thus, closed end 77 prevents end tab 82 of bead 81 from passing beyond the outer end of underwire 75. In addition and as is better seen in FIG. 8 below, closed end 77 is preferably fabricated to cooperate with end tab 82 of bead 81 to provide a locking resistance which prevents bead 81 from being withdrawn outwardly from channel 76.

Figure 8:
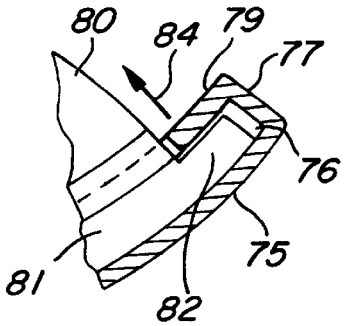
FIG. 8 sets forth a partial section view of the end portion of the cup to undergarment attachment shown in FIG. 5.

FIG. 8 sets forth an enlarged partial section view of the engagement of end tab 82 with closed end 77 of underwire 75. Thus, cup 80 supporting bead 81 along its lower edge is attached to underwire 75 as bead 81 is received within channel 76. Closed end 77 of underwire 75 prevents end tab 82 of bead 81 from going beyond the end of underwire 75. In addition, the extension of end tab 82 beneath lip 79 of closed end 77 resists drawing forces in the direction of arrow 84 which might otherwise tend to separate bead 81 from channel 76 of underwire 75. As a result, end tab 82, lip 79 and closed end 77 cooperate to secure the side portion of cup 80 and bead 81 within channel 76 of underwire 75.

FIG. 9 sets forth a perspective assembly view of a still further alternate embodiment of the present invention undergarment generally referenced by numeral 100. Undergarment 100 includes a cincher 101 formed of a resilient sheath 102 and defining an upper edge 103. A curved underwire 104 is secured to resilient sheath 102 and extends downwardly forming an upwardly open curved portion. Underwire 104 defines a pair of generally parallel grooves 105 and 106 formed on the interior surface of underwire 104. It should be understood that the sizes of underwire 104 and lock 111 are exaggerated in FIG. 9 for illustration purposes. In the actual garment, they would be of the same general size as the "zip-locks" found on plastic bags. Garment 100 further includes a breast-supporting cup 110 having a curved lock member 111 secured to the lowered edge of the cup. Lock member 111 defines a pair of downwardly extending parallel ribs 112 and 113 separated by a channel 114. Cup 110 is removably secured to cincher 101 by aligning ribs 112 and 113 with grooves 105 and 106 respectively of underwire 104. Thereafter, ribs 12 and 13 of lock member 111 are forced into grooves 105 and 106 respectively in a form of attachment similar to a plastic zip-lock releasible attachment. Cup 110 may be removed from cincher 101 by simply withdrawing lock 111 from underwire 104.

FIGS. 10A and 10B set forth partial section views of garment 100 taken along section lines 10—10 in FIG. 9. FIG. 10A shows lock 111 and underwire 104 separated prior to attachment of cup 110 to cincher 101. Conversely, FIG. 10B sets forth cup 110 attached to cincher 101 by the above-described zip-lock attachment of lock 111 to underwire 104. As can be seen, ribs 112 and 113 are received within grooves 105 and 106 respectively of underwire 104. As can also be seen, rib 107 extending between grooves 105 and 106 as is better seen in FIG. 9, is received within channel 114 of lock member 111.

FIG. 11 sets forth a partial perspective assembly view of a still further alternate embodiment of the present invention undergarment generally referenced by numeral 120. Garment 120 includes a cincher 121 formed of a resilient sheath 122 having an upper edge 123 and an underwire 124. Underwire 124 forms a downwardly curved upwardly open support wire preferably covered by a fabric material generally referred to as the "sleeve" or "jacket" and preferably sewn or stitched to resilient sheath 122. In accordance with conventional fabrication techniques, underwire 124 may be formed of virtually any wire material such as metal wire or a resilient plastic element. Cincher 121 further supports an attachment band 125 preferably joined to the sleeve or jacket of underwire 124 or alternatively joined to resilient sheath 122 and underwire 124 using conventional fabrication techniques such as sewing or stitching. Attachment band 125 supports a pair of snap fastener members 127 and 128 at the upper ends thereof. Attachment band 125 further supports a layer of fabric material 126. In its preferred form, fabric material 126 forms the loop portion of a conventional hook and loop fabric attachment means. It will be apparent however that other fabric attachments between bands 131 and 125 such as plural snaps may be used.

Undergarment 20 further includes a breast-supporting cup 130 having an attachment band 131 secured to the lower edge thereof using conventional fabrication techniques such as sewing or stitching. Attachment band 131 further supports a pair of complementary snap fasteners 133 and 134 configured to engage snap fasteners 128 and 127 respectively. In its preferred form, attachment band 131 further supports a layer of fabric attachment 132 which may for example be formed of a hook fabric portion of a conventional hook and loop fabric attachment.

Cup 130 is removably securable to cincher 121 by aligning cup 130 with underwire 124 and thereafter snapping fasteners 133 and 134 to fasteners 128 and 127. Thereafter, the overlying portions of fabric attachment pads 132 and 126 are pressed together to complete attachment. It will be apparent to those skilled in the art that while fabric attachment pad 126 is preferably formed of a loop fabric and fabric pad 132 is preferably formed of a hook fabric pad, the fabric portions may be reversed without departing from the spirit and scope of the present invention. The essential feature of fabric pads 126 and 132 is their cooperative engagement for providing a removable attachment.

FIG. 12 sets forth a partial perspective assembly view of a still further alternate embodiment of the present invention undergarment generally referenced by numeral 140. Undergarment 140 includes a cincher 141 formed of a resilient sheath 142 having an upper edge 143. Sheath 142 further supports an underwire 144 secured to sheath 142 using conventional attachment such as sewing or stitching and forming a downwardly curved upwardly open underwire support. A band 146 preferably formed of a fabric material supports a plurality of inwardly facing snap fastener members 147 and is secured to underwire 144 using conventional fabric attachment such as sewing or stitching. A fabric rib 145 is secured to the outer edge of band 146.

Garment 140 further includes a breast-supporting cup 150 having a band 151 secured to the bottom edge thereof using conventional fabric attachments such as sewing or stitching. Band 151 is preferably formed of a flexible fabric and supports a plurality of snap fasteners 152 facing outwardly and forming complementary snap fasteners for cooperative attachment to snap fasteners 147 on band 146.

Thus, cup 150 is attached to cincher 141 by aligning band 151 with band 146 and thereafter forcing the aligned snap fasteners 152 into snap-fit attachment with snap fasteners 147 on band 146. Removal of cup 150 is obtained by simply separating snaps 152 from snaps 147. It will be understood by those skilled in the art that the embodiments of the present invention undergarment set forth in FIGS. 5 through 12 utilize a pair of breast-supporting cups secured to respective cinchers in the same general manner as set forth above in FIGS. 1 through 4 in which a pair of breast-supporting cups are secured to each side of the frontal portion of the respective cinchers. It will be equally apparent to those skilled in the art that while a single cup attachment is shown in the embodiments set forth in FIGS. 5 through 12, a pair of cups is utilized in the respective cinchers set forth therein. Further, it will be apparent to those skilled in the art that while the present invention combination brassiere and undergarment having removable cups is set forth using an undergarment generally described as a cincher, the present invention may be utilized equally well with other types of torso covering garments such as those described above in the background of the invention and referred to as girdles, midriff supports or other torso covering garments. It will also be apparent to those skilled in the art that the attachment apparatus utilized in the above-described embodiments for securing the breast-supporting cups to the cincher in a removable attachment may be reversed between the cincher and the breast-supporting cup without departing from the spirit and scope of the present invention. The essential feature of the present invention being the ability of the breast-supporting cups to be removed from and secured to the torso covering undergarment such that, once secured, the breast-supporting cups are immovable with respect to the remainder of the garment.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A combination brassiere and undergarment comprising:

a torso covering garment portion having an upper edge and a sheath for enclosing a portion of a wearer's torso;

a pair of breast-supporting cups each defining a curved lower edge;

a pair of underwires fixedly secured to said sheath and extending downwardly from said upper edge to form upwardly open edges corresponding generally to said lower edges of said pair of breast-supporting cups;

first attachment means fixedly secured to said lower edge of said breast-supporting cups; and second attachment means, supported on said upwardly open edges of said underwires, for cooperating with said first attachment means to fixedly attach said pair of breast-supporting cups to said torso covering garment portion in a removable attachment such that said breast-supporting cups when attached by said cooperation of said first and second attachment means become fixedly attached to said torso covering garment and remain immovable with respect to said torso covering garment at the position defined by the attachment thus formed despite movement by a wearer.

2. A combination brassiere and undergarment as set forth in claim 1 wherein said second attachment means are formed upon said underwires.

3. A combination brassiere and undergarment as set forth in claim 2 wherein said first attachment means includes at least one bead and wherein said second attachment means includes at least one channel for receiving said at least one bead.

4. A combination brassiere and undergarment as set forth in claim 3 wherein said underwire is formed of a resilient plastic material.

5. A combination brassiere and undergarment as set forth in claim 4 wherein said at least one bead is assembled to said at least one channel by forcing said at least one bead into said at least one channel.

6. A combination brassiere and undergarment as set forth in claim 4 wherein said at least one bead is slidingly assembled to said at least one channel.

7. A combination brassiere and undergarment as set forth in claim 6 wherein said at least one channel defines an open end and a closed end.

8. A combination brassiere and undergarment as set forth in claim 2 wherein said first attachment means includes a plurality of spaced outwardly facing ribs and wherein said second attachment means defines a plurality of grooves for receiving said ribs.

9. A combination brassiere and undergarment as set forth in claim 8 wherein said underwire is formed of a resilient plastic material.

10. A combination brassiere and undergarment as set forth in claim 1 wherein said first attachment means includes a first band of attachment pad fabric and wherein said second attachment means includes a second band of attachment pad fabric, said attachment pad fabrics of said first and second bands forming a hook-and-loop attachment.

11. A combination brassiere and undergarment as set forth in claim 10 wherein said first and second attachment means include first and second pluralities of snap fasteners.

12. A combination brassiere and undergarment as set forth in claim 11 wherein said first band of attachment fabric is hook fabric and said second band of attachment fabric is loop fabric.

13. A combination brassiere and undergarment as set forth in claim 1 wherein said first and second attachment means include first and second pluralities of snap fasteners.

* * * * *